US006539741B2

(12) United States Patent
Navarro

(10) Patent No.: US 6,539,741 B2
(45) Date of Patent: Apr. 1, 2003

(54) AIR CURTAIN FOR OPEN-FRONTED REFRIGERATED SHOWCASE

(76) Inventor: Ramon Munoz Navarro, 4829 E. Walnut Ave., Orange, CA (US) 92869

( * ) Notice: Subject to any disclaimer, the term of this patent is extended or adjusted under 35 U.S.C. 154(b) by 0 days.

(21) Appl. No.: 09/932,962

(22) Filed: Aug. 21, 2001

(65) Prior Publication Data

US 2002/0062654 A1 May 30, 2002

Related U.S. Application Data

(62) Division of application No. 09/709,500, filed on Apr. 24, 2001, which is a division of application No. 09/201,778, filed on Dec. 1, 1998, now Pat. No. 6,145,327.

(60) Provisional application No. 60/089,145, filed on Jun. 12, 1998.

(51) Int. Cl.[7] ..... F24F 9/00; A47F 3/04

(52) U.S. Cl. ..... 62/256; 454/193

(58) Field of Search ..... 62/255, 256; 454/193

(56) References Cited

U.S. PATENT DOCUMENTS 2,661,604 A * 12/1953 Baker ..... 62/252
3,125,864 A * 3/1964 Ural ..... 62/248
3,229,475 A * 1/1966 Balk et al. ..... 62/246
3,289,432 A * 12/1966 Brennan et al. ..... 62/256
3,756,038 A * 9/1973 MacMaster et al. ..... 62/256
4,148,197 A * 4/1979 Karashima ..... 62/256
4,370,866 A * 2/1983 Abraham ..... 62/256
4,592,209 A * 6/1986 Casanova et al. ..... 62/255
4,633,677 A * 1/1987 Maehara ..... 62/256
5,502,979 A * 4/1996 Renard ..... 312/116

* cited by examiner

*Primary Examiner*—William E. Tapolcai
(74) *Attorney, Agent, or Firm*—William D. Breneman; Peter J. Georges; Breneman & Georges

(57) ABSTRACT

A refrigerated showcase has a front opening through which a consumer can view and access foodstuffs on display. The foodstuffs are cooled by coolant air introduced through a slanted, perforated, interior panel located near a rear wall of the showcase. An air curtain directed downwardly at the front opening minimizes coolant air loss through the opening. Lips are applied and extended from the edges of vertical sides of the access opening to reduce the loss of coolant air through the air curtain. Thus, relative flows of coolant air and the air curtain are maintained inside the showcase.

30 Claims, 5 Drawing Sheets

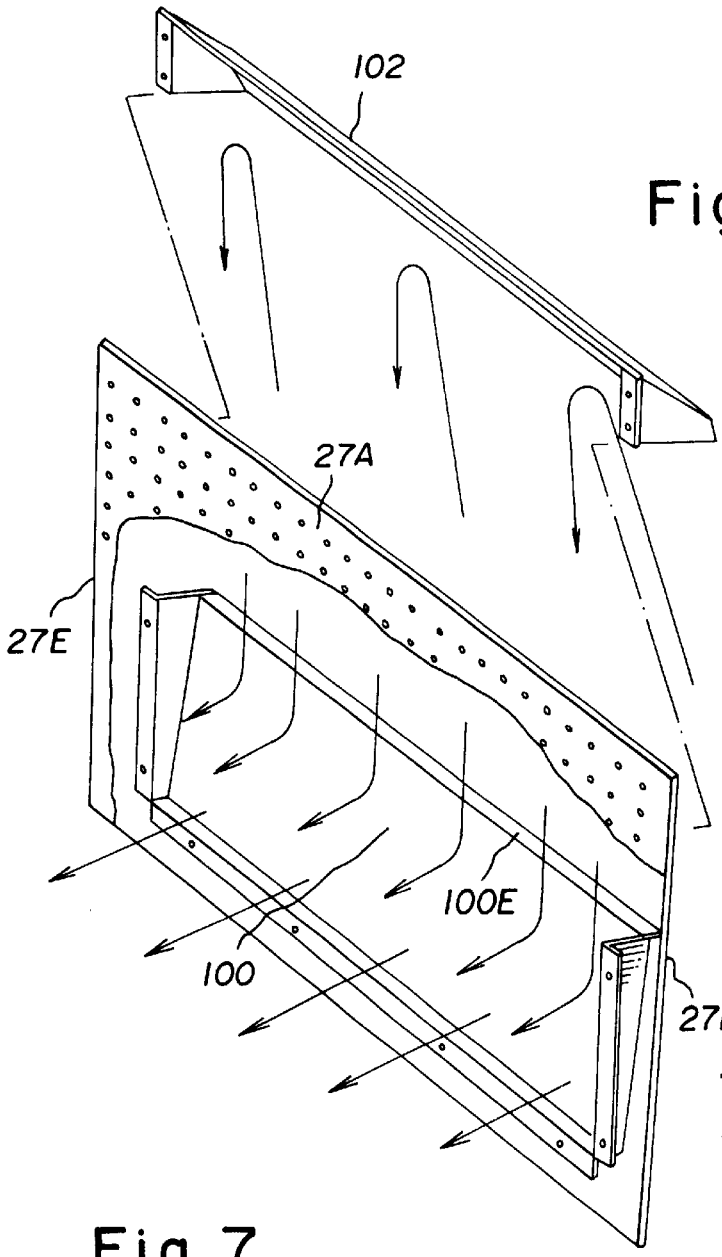
Fig. 5
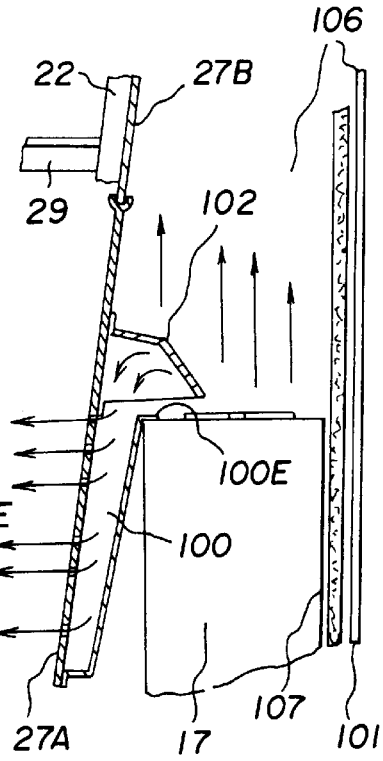
Fig. 6
Fig. 7
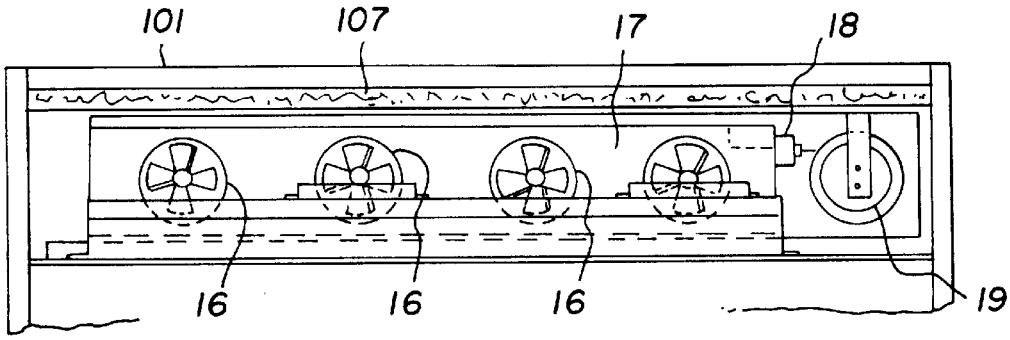

AIR CURTAIN FOR OPEN-FRONTED REFRIGERATED SHOWCASE

This is a divisional application of Ser. No. 09/709,500 allowed Apr. 24, 2001, in turn a divisional application of Ser. No. 09/201,778, filed Dec. 1, 1998 which issued Nov. 14, 2000 as U.S. Pat. No. 6,145,327.

This application is derived from Provisional Patent Application Serial No. 60/089,145 filed on Jun. 12, 1998:

BACKGROUND OF THE INVENTION

1. Field of the Invention

The present invention relates broadly to refrigerated showcases, particularly open-fronted display and storage cases with air curtains. More specifically, the present invention relates to a refrigerated showcase having an opening through which a consumer can view and access stored items on display and to such a showcase wherein cooling air is introduced through a perforated interior panel with the coolant air maintained within the refrigerated compartment by an air curtain passed downwardly within the showcase opening.

2. Description of the Related Art

An example of this type of showcase is described in U.S. Pat. No. 3,696,630 granted on Oct. 10, 1972, to Bressickello who discloses various self-service showcases constructed with front access openings for the purpose of displaying comestibles such as meat, eggs and vegetables. In such showcases, the cooling system includes a refrigerant coil, also known as an evaporator coil, which is located in such position so as to cool air circulating through the showcase.

The refrigerant coil is sometimes oriented above a relatively small drip pan, also referred to as a dissipater pan situated in a location so as to collect condensation from the coil. When the water level rises to a predetermined level, this condition is sensed and a pump is activated to lift the water to an overhead dissipater pan arranged on top of the showcase. The dissipater pan may include a heating coil to dissipate any accumulated water. Other showcases eliminate condensation from the refrigerant coils by a drainage system that communicates with a floor sink.

An example of a showcase of the type where condensation from the evaporator coil is pumped to a dissipater pan arranged on top of a cabinet of the refrigerated showcase is illustrated in U.S. Pat. No. 4,766,737 granted on August, 1988, to Baxter, II. In this prior art device, a high temperature coil of the condenser assembly is associated with the lowermost of an array of dissipater pans in order to effect the transfer of heat to the condensate which has been pumped up to the dissipater array atop the cabinet of the refrigerated showcase.

The open-fronted, refrigerated showcases with air curtains in the prior art have reached a level of efficiency such that additional improvements are not readily achieved.

It is well known in the prior art to use perforated wall dividers and/or rear panels which are angled to form an air plenum in association with the back of the showcase. These air plenums are shaped to have a decreasing volume through which cooled air is passed upwardly with the flow also passing through perforations in the wall dividers into the refrigerated showcase. This feature is illustrated in U.S. Pat. No. 3,696,630 previously mentioned and in U.S. Pat. No. 5,345,778 issued on Sep. 13, 1994, to Roberts.

It is also known to route cooled air to a bottom portion of cooling compartments where foodstuffs are stored. Bottom storage bins, where foodstuffs are placed to replenish the display shelves located above the storage area, are commonplace. However, cooling the storage area is difficult to do. Prior art devices have cooled the storage are by diverting a portion of the cooled air which is flowing upwardly from housings in which evaporator coils and air-moving fans are arranged. An example of such an arrangement is found in U.S. Pat. No. 5,345,778 just mentioned.

SUMMARY OF THE INVENTION

In accordance with the present invention, three methods of improving air curtains in open-fronted refrigerated showcases have been incorporated in the refrigerated compartment, in the refrigerant system atop the cabinet, and in the air circulation system.

As shall be fully explained below, one purpose of the present invention is to achieve optimal heat exchange by continuously trapping particles suspended in the air that flows into the components of the refrigerant system which over time becomes fouled and impedes air flow and/or the efficiency of the heat exchange. In particular, an air filter is used atop the showcase. This air filter and precondenser coils, situated beneath the air filter, are both exposed and susceptible to fouling. Advantageously, these elements of the present refrigeration system are cleaned by condensate originating at the evaporator coils. This condensate is pumped from a lower drip pan up to the top of the showcase, then expelled over the air filter. The condensate then travels from the air filter over the precondenser coil into the dissipater pan. The precondenser coil, preferably made of copper tubing, is inserted between the compressor and the condenser coil. As the refrigeration gas is sucked from the evaporator coil, the compressor places the gas under a higher pressure, thus raising the gas temperature. The hot gas is then pushed into the precondenser coil which has a sufficient length to evaporate the water that lands in the dissipater pan. The lengthy copper tubing coil between the compressor and the condenser coil functions to evaporate the water which has collected during the operation of the refrigerated showcase. The precondenser coil is situated in the dissipater pan, suitably resting on the bottom of the pan, with at least a portion of the coil exposed to the atmosphere in the open section of the top of the showcase. The precondenser coil also sits forward of the face of the air filter. Preferably, a major portion of the precondenser coil is exposed to the atmosphere. The precondenser coil also assists the condenser coil by precondensing the refrigerant. The air is pulled through the space where the filter, precondenser and dissipater pan is located. The air then circulates outside the precondenser coil and acts as a heat exchange medium. Precondensing refrigerant gas into liquid, moreover, makes the condensing system more efficient.

Another aspect of the present invention, as shall also be further explained below, is to minimize coolant air loss through the showcase opening. This advantage is achieved by a method of identifying, measuring, and ameliorating coolant air loss by providing a lip along vertical sides of the opening in the refrigerated compartment. The lips extend vertically along at least a portion of each of the two vertical sides of the opening where, as it has been discovered, the loss of cooled air from the refrigerated compartment is greatest.

The present invention also provides an apparatus for assuring proper cooling at the bottom of the refrigerated compartment of the showcase.

A further aspect of the present invention relates to the use of an air divider and plenum arrangement which directs the coolant air through perforations in the back of the refrigerated compartment so that the coolant air flows over foodstuffs which are stored at the bottom of the refrigerated compartment in an area beneath the lowermost display shelf. In other words, a diverter and plenum arrangement is utilized to achieve routing of the coolant air to the bottom of the refrigerated compartment below the lowermost display shelf in a facile manner.

It has also been found that, in refrigerated showcases wherein there is an opening in the front thereof through which a consumer can view and access foodstuffs on display, these foodstuffs in the showcase are cooled by cold air introduced from a perforated panel. Such refrigerated showcases include an air curtain generated within and directed downwardly from the top of the opening. After a determination of the flow rate, the loss of coolant air through the air curtain can be either reduced or prevented altogether by using lips that extend from the vertical edges partially into the opening.

The following method can be used to determine the dimensions of the lips that limit coolant air loss through the air curtain. In open-fronted, refrigerated showcases, a 4" lip on each side has been found suitable to minimize the coolant air loss along the vertical edges of any refrigerated compartment which has an opening of about 56" in height. The method of determining the size of the lips needed for the vertical edges involves several steps.

First, load the refrigerator shelves with the product to be refrigerated and displayed, preferably at a desirable product temperature sufficient to avoid the possibility of spoilage. Actually, this step can be omitted, but it is preferred to use a stocked compartment.

Second, adjust the rate of flow of the coolant air to obtain a stable air curtain. This step is achieved by producing a nominal air flow of 500 cubic feet per minute by four pans which are each rated at 125 cubic feet per minute so that an actual air flow rate of about 330 cubic feet per minute is obtained.

Third, introduce a visible additive, such as artificial smoke to the circulating air in order to enable observation and identification of any air escaping at the periphery of the front opening.

Fourth, apply a first lip extending from one vertical side edge into the opening and a second lip extending from another opposite vertical side edge into the same opening.

Fifth, observe, by increasing and/or decreasing, the extension of the lips into both side edges of the opening. When the escape of air through the air curtain is minimized at the vertical periphery of the opening in the refrigerated showcase, the optimal lip size has been empirically determined.

The lips are then affixed to the vertical side edges which extend into the opening in the showcase a distance based on the observations made in order to limit the loss of coolant air through the air curtain.

Thus, in accordance with the present invention, the loss of coolant air through the air which is passed over the displayed products is minimized. The coolant air then emerges from the refrigerated compartment for recycling with the circulating air forming the air curtain at the opening in the showcase. As heretofore noted, the optimum conditions for operation and determination of lip size are identified empirically by observing and adjusting the size of the lips which minimize the loss of coolant air at the vertical peripheries of the opening in the refrigerated compartment.

Furthermore, the controlled flow of coolant air through perforated openings in the panel is facilitated by an air divider and plenum arrangement that provides for adequate contribution of the coolant air the food storage area which is located at the bottom of the refrigerated compartment, typically beneath the first storage shelf. As air is ejected upwardly by the four fans in the fan housing, the air is pushed between the back wall which is plumbed straight and the perforated panel which is inclined slightly backwards by approximately six degrees from its vertical axis. The perforated panel has at its lower end the air divider and plenum arrangement situated beneath the first display shelf. The air divider and the plenum arrangement are installed to force air flow through the perforated panel into the bottom storage section of the refrigerated compartment. Thus, air flow equilibrium throughout the perforated panel, including the bottom storage section of the refrigerated compartment, is accomplished. This equilibrium is achieved by forcing air to be approximately the same amount in all spaces where the products are placed. The reason for this result is believed to be that the air travels fastest when it is nearest to the fans, so that the air travels to the upper part of the panel and crosses through the perforations with great ease.

The multiple fans, which move cooled air over the evaporator coils situated in the bottom of the refrigerated compartment, reduce condensation on the evaporator coils that are used to cool the air circulating in the showcase so that icing is reduced on the evaporator coils.

Water collecting on the evaporator coils is captured in an evaporation tray situated below the evaporator coils and is pumped to the top of the showcase where the condenser is located. At the top, the water sequentially is passed over a filter which functions as a water evaporator and also functions to remove particulate matter and other foulants, whereby the water from the evaporator coils functions both to clean the filter and to cool the air passing through the filter before the air contacts the condenser coils of the refrigeration system. The water runs from the filter to the dissipater pan and then to the precondenser coils carrying refrigerant from the compressor. These precondenser coils are thus cooled by cold water originating at the evaporator coils. The filtered air passing over the condenser coils, which air is further cooled before contact by the water, passes over and/or through the filter before absorbing heat produced during refrigerant condensation. At the same time, the rate of evaporation from the dissipater pan lying under the precondenser coils is substantially increased and the risk of water overflow is minimized. The heat generated during compression is exchanged through both the condenser coils and the precondenser coils which comprise another set of coils located downstream of the condenser coils. The precondenser coils in essence function as heating coils to assist in the evaporation of water from the dissipater pan using the heat of condensation, thereby providing two desirable fictions using energy available within the refrigeration system itself, namely removing heat from the compressed refrigerant and adding heat to the condensate which accumulates in the dissipater pan.

Furthermore, the present invention relates to a self-service refrigerated showcase having therein an enclosure for the display of cooled foodstuffs. The enclosure has a front access opening defined by top, side, and bottom housing panels. At its sides, the enclosure is defined by vertically elongated strips corresponding to the side housing panels. This enclosure provides access to the foodstuffs on display.

Also, the enclosure has other advantageous features. For example, there is a perforated panel through which coolant air is introduced and passed over the foodstuffs. Also, there is a top panel having near to the forward part thereof a structure for forming an air curtain which moves coolant air downwardly within the front access opening after diverting the coolant air from the perforated panel. This coolant air originated from a space behind the perforated panel before reaching the access opening.

In accordance with the present invention, a structure is provided for minimizing air loss through the front access opening. This structure is a lip extending from each of the housing side walls along at least a portion of the length of the opening. In this way, coolant air loss which has been observed to occur predominately at the vertical periphery of the opening is substantially prevented.

BRIEF DESCRIPTION OF THE DRAWINGS

FIG. 5 is an exploded perspective view showing air flow through a perforated panel within the refrigerated showcase FIG. 6 is a detailed side elevational view showing the air flow through the perforated panel illustrated in FIG. 5.

FIG. 7 is a detailed top plan view of fan motors for circulating air flow through the perforated panel illustrated in FIGS. 5 and 6.

DETAILED DESCRIPTION OF THE PREFERRED EMBODIMENT

Figure 1:
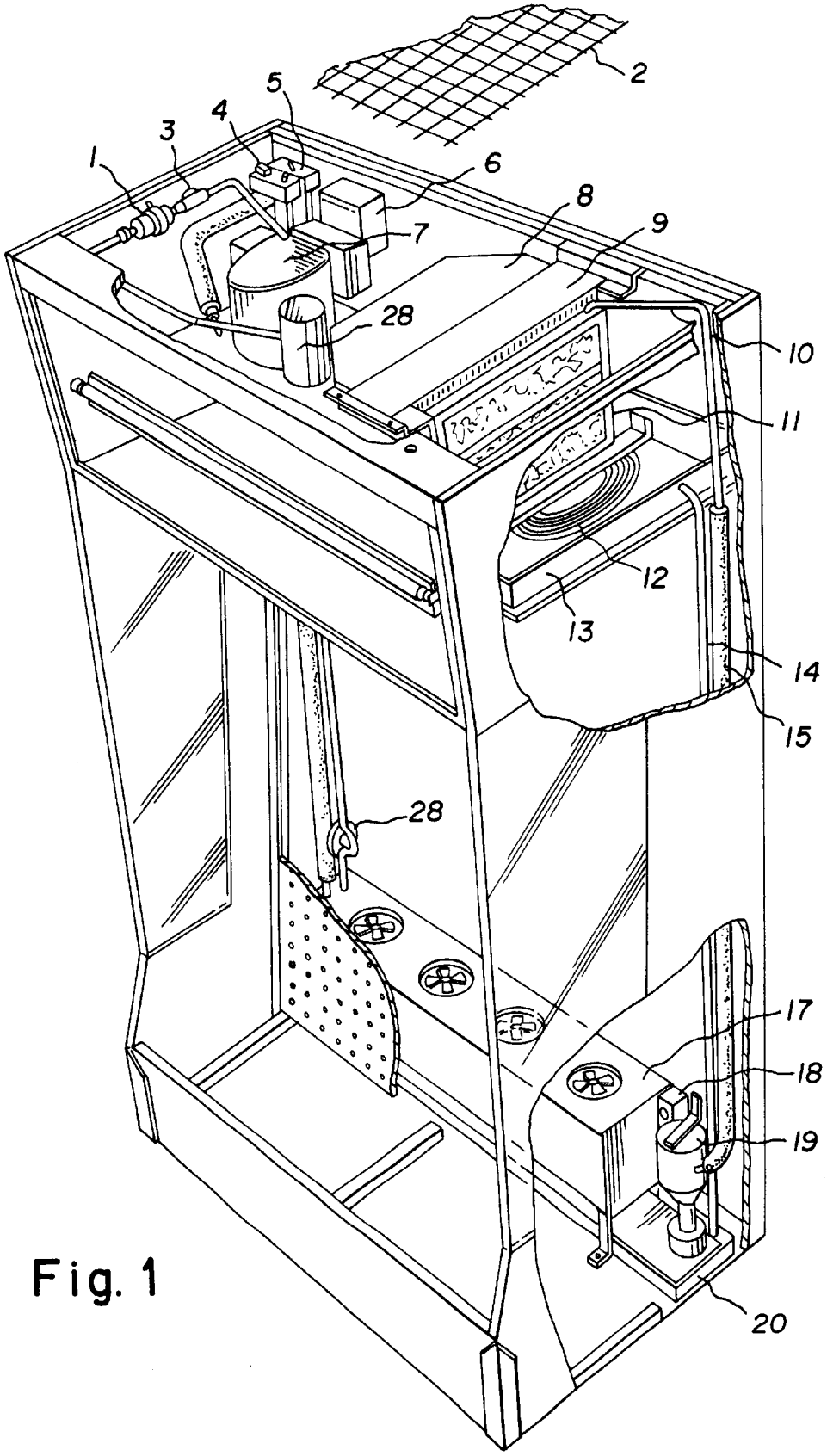
FIG. 1 is a top, partially cutaway, perspective view of the refrigerated showcase of the present invention.

FIG. 1 is a view of an overall refrigerated showcase with several cutaway parts. A compressor 7 and its associated components are situated beneath a grid cover 2 on top of the showcase. The principal associated components are a liquid line filter dryer 1, a sight glass 3, a fuse switch 4, a main switch 5, and a main "J" box 6 for supplying electric power. A suitable condenser fan motor 8 is provided by the LRC Coil Co., 9435 Sorenson Avenue, Santa Fe Springs, Calif. 90670. The condenser fan motor 8 is sold as a separate component of LRC Unit No. F3AM-A077. Performance data is as follows:

PERFORMANCE DATA
R-22 CAPACITIES (BTUH) AT 90° F. AMBIENT

| UNIT | | MAXIMUM AMBIENT | | SATURATED TEMPERATURE/PRESSURE AT COMPRESSOR SUCTION | | | | |
|---|---|---|---|---|---|---|---|---|
| | | | | 30° F. | 25° F. | 20° F. | 15° F. | 10° F. |
| MODEL NO. | HP | COMP | AT 25° F. | 54.8# | 48.6# | 42.9# | 37.6# | 32.7# |
| F3AM-A051 | ½ | JRF4 | 106° | | 4,740 | 4,290 | 3,860 | 3,460 |
| F3AM-A059 | ½ | JRF4 | 119° | 5,890 | 5,330 | 4,760 | 4,280 | 3,800 |
| F3AM-A079 | ¾ | RSN6 | 112° | 8,310 | 7,710 | 7,020 | 6,300 | 5,560 |
| F3AM-A077 | ¾ | RRG4 | 114° | 8,070 | 7,350 | 6,570 | 5,810 | 5,105 |
| F3AM-A078 | ¾ | RSN6 | 113° | | 7,403 | 6,730 | 6,030 | 5,340 |
| F3AM-A101 | 1 | REB3 | 112° | 10700 | 9,740 | 8,730 | 7,730 | 6,750 |
| F3AM-A102 | 1 | REY3 | 105° | 12100 | 11100 | 10000 | 8,980 | 7,990 |
| F3AM-A105 | 1 | REK3 | 120° | 10700 | 9,600 | 8,540 | 7,570 | 6,610 |
| F3AM-A175 | 1¾ | CRC1 | 116° | 15500 | 13800 | 12200 | 10700 | 9,110 |
| F3AM-A201 | 2 | CRD1 | 113° | 16300 | 14800 | 13100 | 11500 | 9,140 |
| MAXIMUM RETURN GAS TEMP. | | | | 65° F. | 65° F. | 65° F. | 65° F. | 40° F. |

NOTES:

-continued

PERFORMANCE DATA
R-22 CAPACITIES (BTUH) AT 90° F. AMBIENT

| UNIT | MAXIMUM AMBIENT | | SATURATED TEMPERATURE/PRESSURE AT COMPRESSOR SUCTION | | | | |
|---|---|---|---|---|---|---|---|
| MODEL NO. | HP | COMP AT 25° F. | 30° F. | 25° F. | 20° F. | 15° F. | 10° F. |
| | | | 54.8# | 48.6# | 42.9# | 37.6# | 32.7# |

The return gas temperature is restricted when operating at 10° F. suction temperature. See the far right column above. Operating at higher return gas temperatures will shorten compressor life. Refer to AE Bulletin 4-1292 for additional information. Refer to the table above for the maximum allowable operating ambient temperature for the unit. This is the maximum permitted temperature of the air entering the condenser coil so as not to exceed the maximum permitted compressor condensing temperature of 140° F. (130° F. at 10° F. suction). Values are determined at suction with a clean, unobstructed condenser coil. At 30° F., when applicable, reduce the allowable ambient temperature by 5° F. For additional units, refer to Form 3.0905 (R-22 High Temperature Units). Capacities are rated at the maximum return gas temperatures shown above and 5° F. subcooling. Pressures are listed in PSIG (#) and reflect the suction pressure at the compressor intake jet. Temperatures shown are the corresponding saturation temperatures. Saturation conditions at the evaporator will be higher due to any pressure drop in the suction line.

A water evaporator filer 11 is placed over the face of a condenser coil box 9. This Filter 11 prevents air-borne particulate matter from fouling the condenser coil box 9. Air drawn by the condenser fan motor 8 first passes through the filter 11 and then through the condenser coil box 9. The filtered air is then free of contaminants which can foul the condenser coils within the box 9. If excess water accumulates in an underlying dissipater pan 13 which holds a copper precondenser coil 12, the water is drained down via an overflow line 14 into a drip pan 20. Water originating from the drip pan 20 is pumped upwardly by a water pump 19 powered by an electric J-box 18 via a water pump line 15 which leads into a water intake tube 10. From the tube 10, the water flows downwardly over the filter 11 and then passes downwardly over the precondenser coil 12 which is located in the dissipater pan 13. Optionally, a spray device can be provided below the filter 11 to distribute the water onto the precondenser coil 12 more evenly or in any other preselected manner. A major portion of the precondenser coil 12 is exposed to the atmosphere and rests on the bottom of the dissipater pan 13. The water evaporates into the atmosphere from the dissipater pan 13.

In order to achieve a more uniform distribution of the condensate water over the entire face of the filter 11, a perforated distribution pan (not shown) may be placed above the filter 11. Likewise, in order to achieve a more uniform distribution over the entire precondenser coil 12, a perforated pan (not shown) may be placed beneath the filter 11 but above the coil 12.

Figure 2:
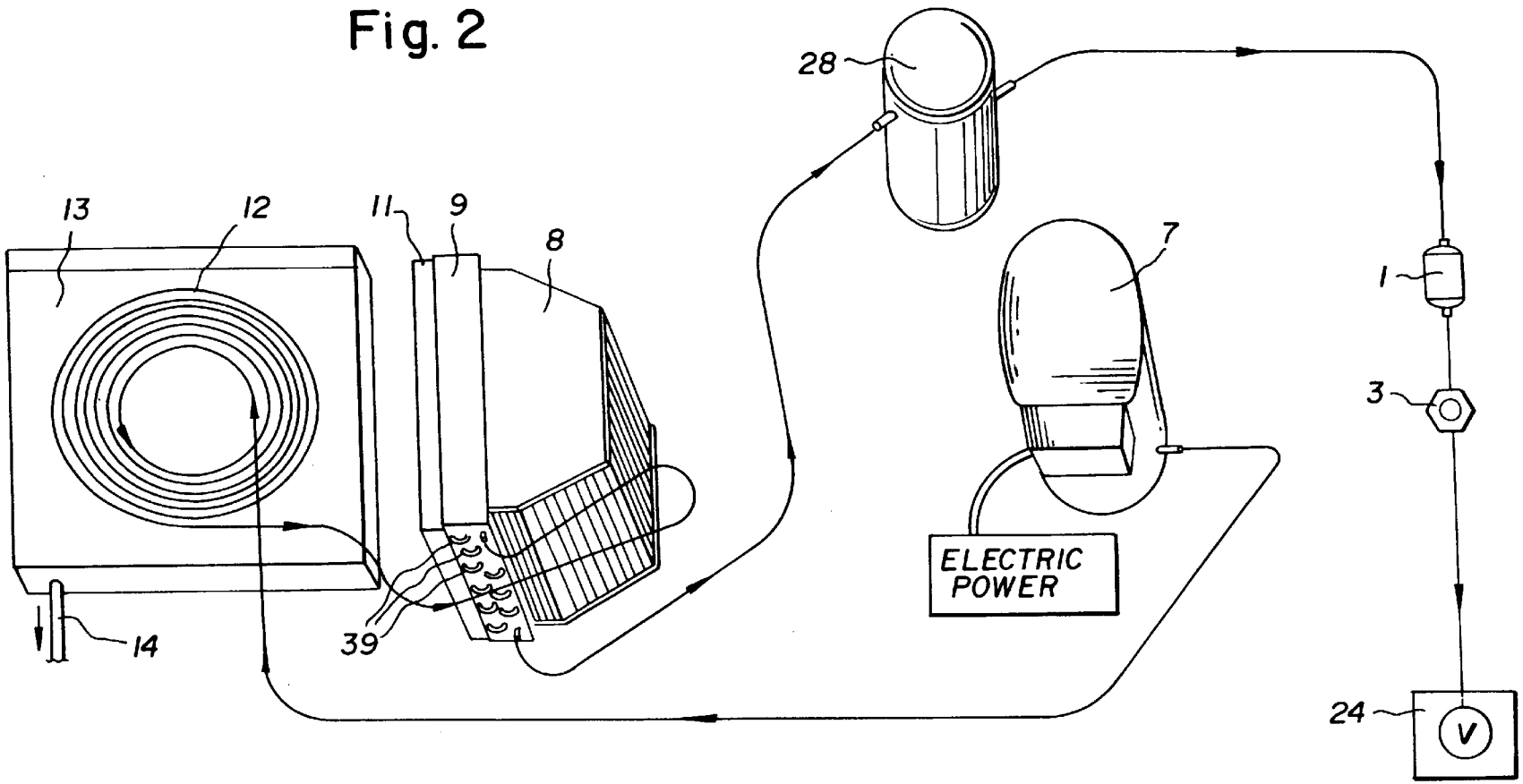
FIG. 2 is a schematic view of the cooling system of the refrigerated showcase.

As best shown in FIG. 2, the overflow line 14 leads out of the dissipater pan 13. The precondenser coil 12 in the dissipater pan 13 is placed in the coolant line between the condenser 7 and the condenser coil box 9. The coolant is then passed from the precondenser coil 12 to the condenser coil box 9 through which cool air is blown by the adjacent condenser fan motor 8. The coolant then goes sequentially through a receiver 28, the liquid line filter dryer 1, and the sight glass 3. After leaving the sight glass 3, the coolant flows down to an expansion valve 24.

Returning to FIG. 1, the coolant exits the expansion valve 24 and then goes to evaporator coils (not shown) located in a coil housing 17 where the air circulated in the refrigerated showcase is cooled.

The precondenser coil 12 is made of ¼" copper tubing which is 30' long and which is coiled to fit inside the dissipater pan 13. A major segment of the coil 12 is preferably placed forward of the filter 11. The top of the condenser coil box 9 and the condenser fan motor 8 form a contiguous top surface which covers these units.

As shown in FIG. 2, this arrangement ensures that the air drawn through condenser coils 39 inside the box 9 is first drawn through the filter 11 where the air is cooled and cleaned.

As seen in FIG. 1, forward of the filter 11, the top of the refrigerated showcase is exposed to the atmosphere by the open-mesh grid cover 2 to facilitate the evaporation of the water warmed by the heat absorbed from the precondenser coil 12 in the pan 13.

Because the grid cover 2 has an open mesh, the section rearward of the condenser fan motor 8 is also exposed to the atmosphere. The compressor 7 and the components associated with the compressor 7 and any other equipment that is used to effect the return of the compressed liquid coolant to the bottom portion of the showcase are not highly vulnerable to fouling by airborne contaminants. Thus, they may be situated in the rearward open section on top of the showcase.

Air from the condenser fan motor 8 is passed through the condenser coil box 9 into the open section behind the condenser fan motor 8. This air which has been cleaned by the filter 11 serves to circulate air around the components in the top section and to carry out particles through the open-mesh grid cover 2, thus helping to keep the rearward part of the top section clean.

Figure 3:
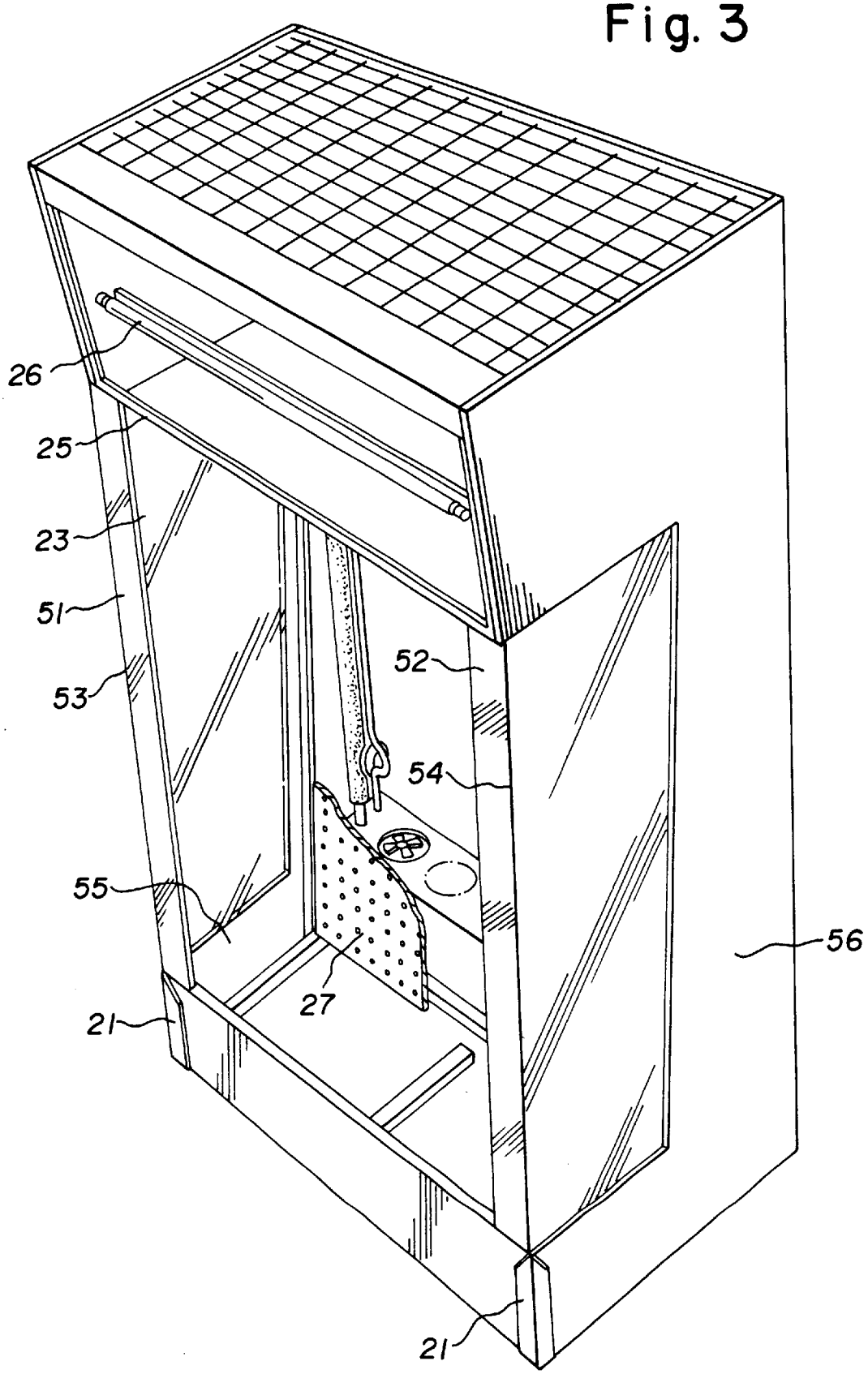
FIG. 3 is a top perspective view of the lip structure of the refrigerated showcase.

FIG. 3 illustrates a front opening of the refrigerated showcase through which a customer can see and access foodstuffs. A fluorescent lamp 26 sheds light on products in the showcase. Mirrors 23 may be placed inside the showcase to reflect light as an aid to customer viewing. A signage track 25 holds a sign (not shown) to attract customer attention. To ensure stability, the showcase has lower steel corners 21.

Lips 51 and 52 are affixed to two vertical side edges 53 and 54. The lips 51 and 52 extend the edges 53 and 54 formed by side walls 55 and 56. The lips 51 and 52 and portions of the side walls 55 and 56 may be made of a clear plastic material which has the advantage of allowing each customer a side view of the products.

The preferred outside dimensions of the refrigerated showcase are 50.75 inches wide, 81 inches high, and 30 inches deep. The preferred inside dimensions are 48 inches wide, 59 inches high, and an average of 20 inches deep. A two-part interior perforated panel 27 is slanted and will be discussed later in regard to FIG. 4. Clear portions of the side walls 55 and 56 are about 16 inches wide and 56 inches high.

Figure 4:
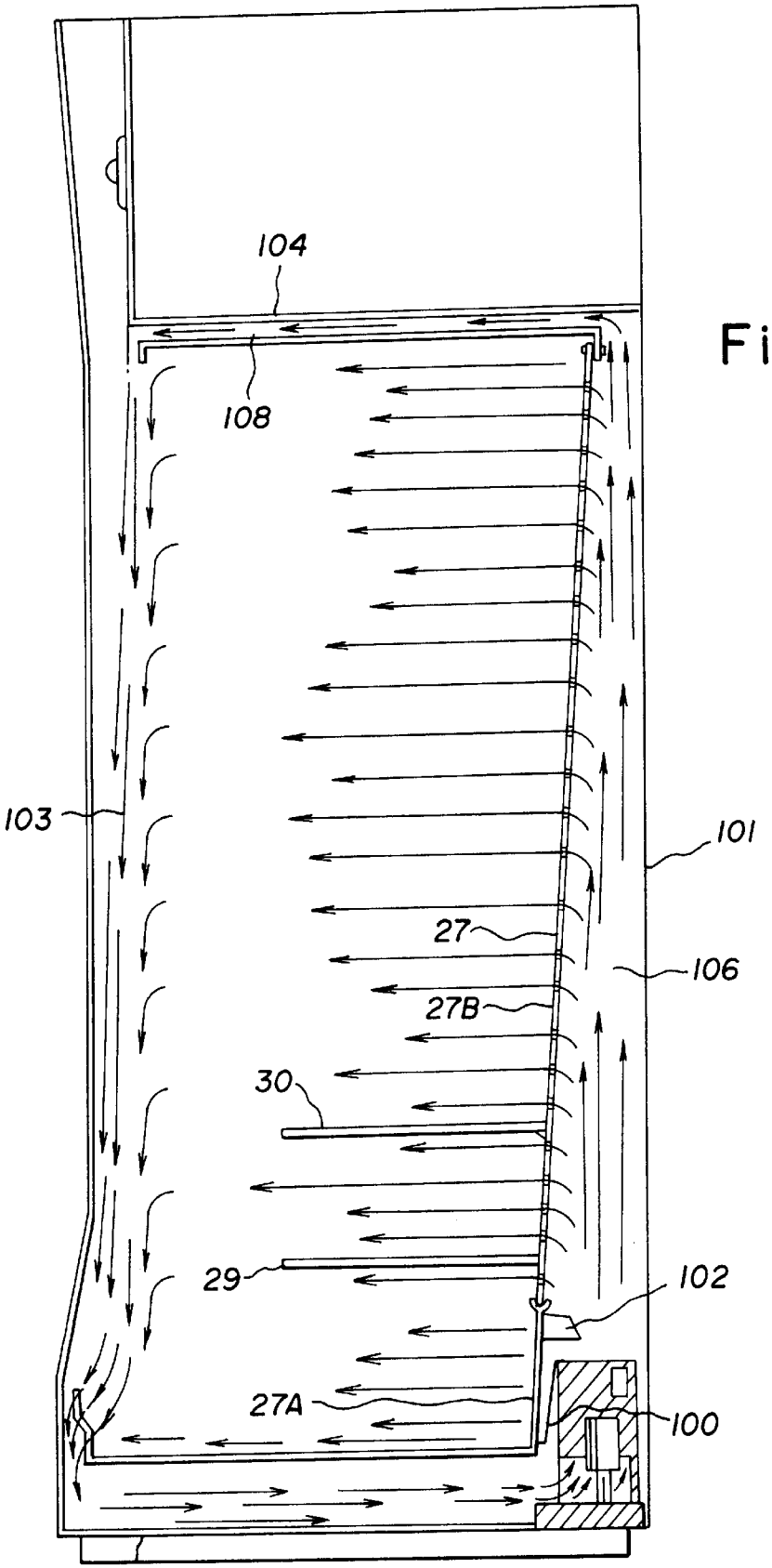
FIG. 4 is a schematic side elevational view of the air flow system within the refrigerated showcase.

For showcases with internal dimensions illustrated in FIGS. 1, 3 and 4, an air flow rate of 330 cubic feet per minute is preferred and the width of the lips 51 and 52 is about four inches for a 56-inch height of the opening.

To describe the provision for adequate air flow to the bottom of the refrigerated compartment, see FIGS. 4–7. This aspect of the invention relates to an auxiliary air handling mechanism.

Referring first to FIG. 5, there is a lower perforated panel 27A. An air divider 102, also called a diffuser top, divides air from an air source into a first portion and a second portion. A first plenum 100, also called a diffuser pan, is disposed behind the panel 27A intermediate side edges 27E and sits below the air divider 102. The air divider 102 has on open bottom configuration for receiving the first portion of air from the air source and is preferably attached by fasteners (not shown) to the panel 27A.

Referring now to FIG. 4, the air divider 102 is attached to the back of the lower perforated panel 27A which, with an upper perforated panel 27B, forms the entire two-part interior slanted panel 27 of the refrigerated compartment. The first plenum 100 preferably has an open top configuration for receiving the first portion of air from the air divider 102. A second plenum 106 extends vertically between the back of the panel 27 and a rear wall 101.

As seen in FIG. 6 the air divider 102 extends further from the lower panel 27A towards the rear wall 101 than the plenum 100. An upper edge 100E of the first plenum 100 is attached to the coil housing 17 for the air source. Alternatively, the air divider 102 may be attached to the coil housing 17. However, this arrangement is not shown.

Nevertheless, in both arrangements, the second portion of the air from the air source inside the coil housing 17 is directed upwardly through the second plenum 106. Also, as seen in FIG. 6, a lower shelf 29 is held in place by a shelf support 22 mounted on the upper pane 127B.

As best shown in FIG. 7, the air source in the refrigerated showcase is four evaporator fan motors 16 inside the coil housing 17. The J-box 18 provides electric power for the fan motors 16 and the water pump 19. The rear wall 101 has interior insulation 107 to reduce temperature changes due to external causes.

Referring back to FIG. 4, the lower shelf 29 along with one of a plurality of upper shelves 30 (others not shown) are illustrated. The use of the two-part panel 27 allows access to the lower panel 27A without disturbing the upper panel 27B of the refrigerated compartment. Regarding the use of the separate lower panel 27A, this arrangement allows repair personnel to work on equipment without disassembling the entire showcase. Thus, the lower panel 27A, which preferably ends beneath the lower shelf 29, can be removed for access behind the panel 27 without disturbing any items on display.

A different aspect of the present invention relates to the opening in the front of the showcase through which a consumer can view and access foodstuffs on display therein. The foodstuffs in the showcase are cooled by air introduced from behind the perforated panel 27. The showcase also includes an air curtain 103 generated within and directed downwardly at the opening.

The invention also involves a method of developing the parameters for balancing the relative air flows of coolant air from behind the perforated panel 27 and from the air curtain 103 to minimize coolant air loss through the opening. By reference to FIGS. 3 and 4 together, the method involves the following steps in series:

(a) as seen in FIG. 4, adjusting the relative flows of the air curtain 103 and the coolant air from behind the panel 27 to maintain the air curtain 103 in a stable condition;

(b) introducing an additive to the circulating air that enables observation and identification of any air escaping at the vertical periphery of the front opening; and (c) as seen in FIG. 3, applying lips 51 and 52 to extend from the edges 53 and 54 of the vertical sides 55 and 56 into the opening to control the loss of coolant air. This loss occurs at the vertical periphery of the opening in the refrigerated showcase.

Referring to FIG. 4, the aspect of the invention relating to ameliorating air loss through the air curtain 103 of the refrigerated showcase depends upon the arrangement of the enclosure for the display of the refrigerated foodstuffs. The enclosure has the opening defined at its top by a top panel 104 and at its bottom by a bottom panel 105. The enclosure further includes the perforated panel 27 through which coolant air is introduced horizontally into the enclosure and passed over the foodstuffs. The top panel 104 has, at a forward part thereof above the front access opening, a channel 108 for forming the flowing air curtain 103 which flows at a high speed so as to prevent the coolant air from the perforated panel 27 from breaking through the access opening. Thus, the slower moving coolant air is diverted downwardly upon reaching the access opening, as seen in FIG. 4.

Returning to FIG. 3, the lips 51 and 52, placed on each of the edges 53 and 54 along the length of the vertically elongated sides 55 and 56, reduce coolant air loss at the sides of the opening. The lips 51 and 52 preferably extend the entire length of each of the edges 53 and 54 which form the vertically elongated sides of the access opening.

Although the principles of the present invention have been illustrated herein in a particular embodiment for refrigerated showcases, it is not intended to limit such principles to that particular device alone, since the same principles are readily applicable to various other forms of devices. Thus, the principles of the present invention should be broadly construed and not limited to the specific embodiments set forth in the appended claims.

I claim:

1. An auxiliary air handling mechanism comprising:

(a) refrigerated display case housing having a substantially vertical air curtain, a refrigerated product display compartment and a product storage area disposed below said refrigerated product display compartment;

(b) a perforated panel spanning the length of said refrigerated product display compartment and said product storage area;

(c) a first plenum disposed in said display case housing adjacent to the perforated panel and opposite said refrigerated product display compartment;

(d) means for dividing air from said first plenum into a first portion to flow substantially horizontally through said perforated panel into said refrigerated product display compartment and a second portion to flow substantially horizontally through said perforated panel into said product storage area and into said substantially vertical air curtain; and (e) a second plenum attached to the perforated panel and arranged adjacent to the air dividing means, said second plenum receiving the first portion of air from the air dividing means.

2. The mechanism of claim 1 wherein the air dividing means is also attached to the perforated panel.

3. The mechanism of claim 2 wherein the air dividing means has an open bottom means for receiving the first portion of air from an air source.

4. The mechanism of claim 1 wherein said first plenum has an open top means for receiving the first portion of air from the air dividing means.

5. The mechanism of claim 2 wherein the air dividing means extends farther from the perforated panel than the second plenum.

6. The mechanism of claim 1 wherein the second plenum is also attached to the air source housing.

7. The mechanism of claim 1 wherein the air dividing means extends over part of said air source housing so as to receive the first portion of air from the air source.

8. The mechanism of claim 7 wherein the air dividing means has an open bottom means for receiving the first portion of air from the air source.

9. The mechanism of claim 7 wherein said second plenum has an open top means for receiving the first portion of air from the air dividing means.

10. The mechanism of claim 1 wherein said perforated panel is inclined away from said refrigerated product display compartment to form a tapered first plenum.

11. A refrigeration device comprising:

(a) a refrigerated showcase having a top, a bottom, a front, a rear wall, a refrigerated product display compartment and a product storage area disposed below said refrigerated product display compartment;

(b) a perforated panel disposed inside the showcase between the front and rear wall said perforated panel extending the length of said product display compartment and said product storage area;

(c) an air source arranged in a housing adjacent to the perforated panel;

(d) means for dividing air from the air source into a first portion to flow through said perforated panel to cool said product storage area and a second portion to flow through said perforated panel to cool said refrigerated product display compartment;

(e) a first plenum attached to the perforated panel and arranged adjacent to the air dividing means and said product storage area, said first plenum receiving the first portion of air; and (f) a second plenum disposed between the rear wall of the showcase and the perforated panel and adjacent said refrigerated product display compartment, said second plenum receiving the second portion of air.

12. The device of claim 11 wherein an air curtain is disposed in the front of the showcase.

13. The device of claim 12 wherein the air curtain is directed downwardly so as to prevent escape of cooled air inside the showcase.

14. The device of claim 11 wherein the air dividing means is also attached to the perforated panel.

15. The device of claim 11 wherein the first plenum has an open top means for receiving the first portion of air from the air dividing means.

16. The device of claim 15 wherein the open top means of the first plenum is also attached to the housing for the air source.

17. The device of claim 11 wherein the air dividing means has an open bottom means for receiving the first portion of air from the air source.

18. The device of claim 17 wherein the air dividing means extends over part of the housing for the air source.

19. The device of claim 18 wherein the first plenum is also attached to the housing for the air source.

20. The device of claim 11 wherein the air source directs cooled air upwardly through the second plenum, across the top of the showcase, and then downwardly in the front thereof to form an air curtain.

21. In a cooling machine having a display showcase, a top, a bottom, a front, a rear wall, a perforated panel disposed between the front and rear wall, a vertical plenum behind the perforated panel, and means for circulating cooled air in the vertical plenum from the bottom and through the perforated panel, wherein the improvement comprises:

(a) an air divider arranged in an inwardly tapering vertical plenum to separate the cooled air into a first portion to flow through said perforated panel into a refrigerated product storage compartment and a second portion to flow through said perforated panel into a refrigerated product display showcase; and (b) an auxiliary plenum attached to the perforated panel adjacent to the air divider so that the first portion of the cooled air may be directed into a refrigerated storage compartment in said refrigerated product display showcase.

22. The machine of claim 21 wherein the air divider is also attached to the perforated panel.

23. The machine of claim 21 wherein the auxiliary plenum is secured to the circulating means.

24. The machine of claim 21 wherein the auxiliary plenum has the open top means for receiving the first portion of the cooled air from the air divider.

25. The machine of claim 24 wherein the open top means of the auxiliary plenum is secured to the circulating means.

26. A refrigeration device comprising:

(a) a refrigerated display case housing having a top, a bottom, a front, a rear wall and a refrigerated product display and a refrigerated product storage area disposed below said refrigerated product display;

(b) a perforated panel extending the length of said refrigerated product display and said refrigerated product storage area;

(c) a tapered plenum tapering upwardly and inwardly from said bottom of said refrigerated display case to the top of said refrigerated display case;

(d) an auxiliary tapered plenum disposed below said tapered plenum; and (e) a diverter disposed in said tapered plenum intermediate said refrigerated product storage area and said refrigerated product display to divert one portion of cooled air to said refrigerated product storage area and another portion of said cooled air to said auxiliary tapered plenum and said product storage area.

27. The refrigeration device of claim 26 further comprising an evaporator device disposed at the bottom of said refrigerated display case housing.

28. The refrigeration device of claim 27 further comprising an evaporation tray disposed below said evaporation device.

29. The refrigeration device of claim 28 further comprising a condenser disposed at the top of said refrigerated display case.

30. The refrigeration device of claim 29 wherein water collected in said evaporation tray is pumped to said condenser to cool said condenser.

* * * * *